US007497554B2

(12) United States Patent
Okuno

(10) Patent No.: US 7,497,554 B2
(45) Date of Patent: Mar. 3, 2009

(54) INK JET PRINT HEAD

(75) Inventor: Tetsuo Okuno, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 476 days.

(21) Appl. No.: 11/181,590

(22) Filed: Jul. 13, 2005

(65) Prior Publication Data

US 2006/0017778 A1 Jan. 26, 2006

(30) Foreign Application Priority Data

Jul. 22, 2004 (JP) ..... 2004-214477

(51) Int. Cl.
*B41J 2/14* (2006.01)
*B41J 2/16* (2006.01)

(52) U.S. Cl. ..... 347/50; 347/68

(58) Field of Classification Search ..... 347/12, 347/17, 18, 20, 40, 50, 68, 70, 71, 72
See application file for complete search history.

(56) References Cited

FOREIGN PATENT DOCUMENTS

JP 2002178509 6/2002

*Primary Examiner*—Juanita D Stephens
(74) *Attorney, Agent, or Firm*—Cohen Pontani Lieberman & Pavane LLP

(57) ABSTRACT

An inkjet print head wherein the surface (front surface) for ejecting ink droplets coming from an ink channel partitioned by a drive wall composed of a piezoelectric device is arranged opposite to the surface (back surface) for supplying ink coming to the ink channel. The connection electrode for driving the piezoelectric device is pulled out to the back surface, and the back surface is a photosensitive glass substrate wherein the ink feed apertures manufactured by exposure and etching process, and the drive wires electrically connected with the connection electrode are formed.

9 Claims, 11 Drawing Sheets

INK JET PRINT HEAD

BACKGROUND OF THE INVENTION

1. Field of the Invention

The present invention relates to an inkjet print head wherein the surface (front surface) for ejecting an ink droplet from an ink channel partitioned by a drive wall composed of piezoelectric devices and the surface (back surface) for supplying ink to the aforementioned ink channel are located face to face with each other.

2. Description of the Related Art

One of the prior art inkjet print heads is a shared wall share mode inkjet print head wherein voltage is applied to the drive wall partitioning an ink channel so that the drive wall is shear-deformed, and the pressure resulting therefrom is utilized to allow ink of the ink channel to be ejected through a nozzle. The Official Gazette of Japanese Patent Tokkai 2002-264342 discloses a share mode inkjet print head, as one of these inkjet print heads, wherein the surface (front surface) for ejecting ink from an ink channel and the surface (back surface) for supplying ink to the aforementioned ink channel are located face to face with each other.

In the aforementioned inkjet print head, the wire for electrical connection between a drive electrode and a drive circuit is led from inside the ink channel up to the outer surface of the head chip so that the FPC (flexible printed circuit board) and others can be connected.

Thus, according to the Official Gazette of Japanese Patent Tokkai 2002-264342, a plurality of straight ink channels with respect to a piezoelectric device substrate are formed by grooving in parallel. Then a plating catalyst is adsorbed, and a thin metal layer is formed on the whole surface by electroless plating. The plated metal film on unwanted positions among ink channels is removed by applying a laser beam all over the head chip to make a wiring pattern, and then plating is provided again to grow the pattern to the desired thickness. Thus, the wire for allowing each drive electrode to conduct is routed all over the head chip. In this case, however, the wire for conducting with the drive electrode is formed so that it will be routed in 3D configuration from inside the ink channel to the back surface of the head chip through the front and back surfaces of the head chip. As a result, the wire is bought into contact with a plurality of the corners of the head chips. The portions in contact therewith tend to cause wire disconnection. This raises a problem with unreliable conduction.

In the Official Gazette of Japanese Patent Tokkai 2001-63043, a wiring pattern of the drive wire for electrical connection of the drive circuit to the nozzle plate with a nozzle formed thereon is formed integrally, and this nozzle plate is attached to the ink outlet side. After that, the side with the aforementioned wiring pattern formed thereon is bent, and electrical connection is made between the connection wire led out onto the top surface of the head chip and the aforementioned drive wire. This technique is disclosed in the aforementioned Official Gazette of Japanese Patent Tokkai 2001-63043.

As described in the Official Gazette of Japanese Patent Tokkai 2001-63043, however, when the drive wire is formed integrally with the nozzle plate, bonding work is so complicated that a bonding failure easily occurs. This is because the nozzle is generally required to be processed to a high precision; hence, it is formed in advance before being bonded with a head chip. To put it another way, in the step of bonding the nozzle, alignment work is essential to ensure exact correspondence between each nozzle and ink channel. Accordingly, when the drive wire is formed integrally with the nozzle plate, both connection between wires and precise alignment between the nozzle and ink channel must be carried out simultaneously.

Further, when a multi-nozzle structure is to be adopted for the purpose of creating a more densely packed inkjet print head, one of the possible methods is to stack a plurality of head chips in multiple layers in the direction orthogonal to the channel arrangement, whereby ink channels in a plurality of rows are created. As described above with reference to the prior art, however, a flexible wiring board is connected to the top surface or bottom surface of the head chip configured in such a way that the front surface and back surface of the head chip are located face to face with each other. When a multi-nozzle row structure is to be adopted using such a head chip, the surface connected with the flexible wiring board is commonly bonded with the opposite surface thereof. According to this method, head chips are stacked in two layers in vertical direction, and ink channels can be formed in two rows alone. Accordingly, the only way of increasing the number of nozzles is to increase the number of the ink channels of each head chip in the direction wherein the ink channels are arranged.

SUMMARY OF THE INVENTION

In view of the prior art described above, it is an object of the present invention to solve the problems contained therein.

Another object of the present invention is to provide an improved version of inkjet print head wherein the front surface and back surface of the head chip are located face to face with each other.

A further object of the present invention is to simplify the electrical connection between the connection wire led from the drive electrode of each ink channel and the drive wire, in the inkjet print-head wherein the front surface and back surface of the head chip are located face to face with each other.

A still further object of the present invention is to provide a more densely packed nozzle structure in the inkjet print head wherein the front surface and back surface of the head chip are located face to face with each other.

These and other objects of the present inventions are attained by an inkjet print head comprising:

a plurality of drive walls, arranged at predetermined intervals, composed of piezoelectric devices;

an upper substrate covering the top portion of the aforementioned multiple drive walls;

a lower substrate covering the bottom portion of the aforementioned multiple drive walls;

a plurality of ink channels enclosed by the drive wall, upper substrate and lower substrate;

an electrode arranged on each drive wall surface;

a connection wire, electrically connected with the aforementioned electrode, led out to the surface of the ink inlet of the ink channel;

a nozzle plate, containing nozzles arranged corresponding to the ink channels, for covering the ink outlet side of the ink channel; and a photosensitive glass substrate covering the ink inlet side of the ink channel (wherein an ink feed aperture and a drive wire electrically connected with the aforementioned connection electrodes are formed on the photosensitive glass substrate through exposure process and etching process).

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
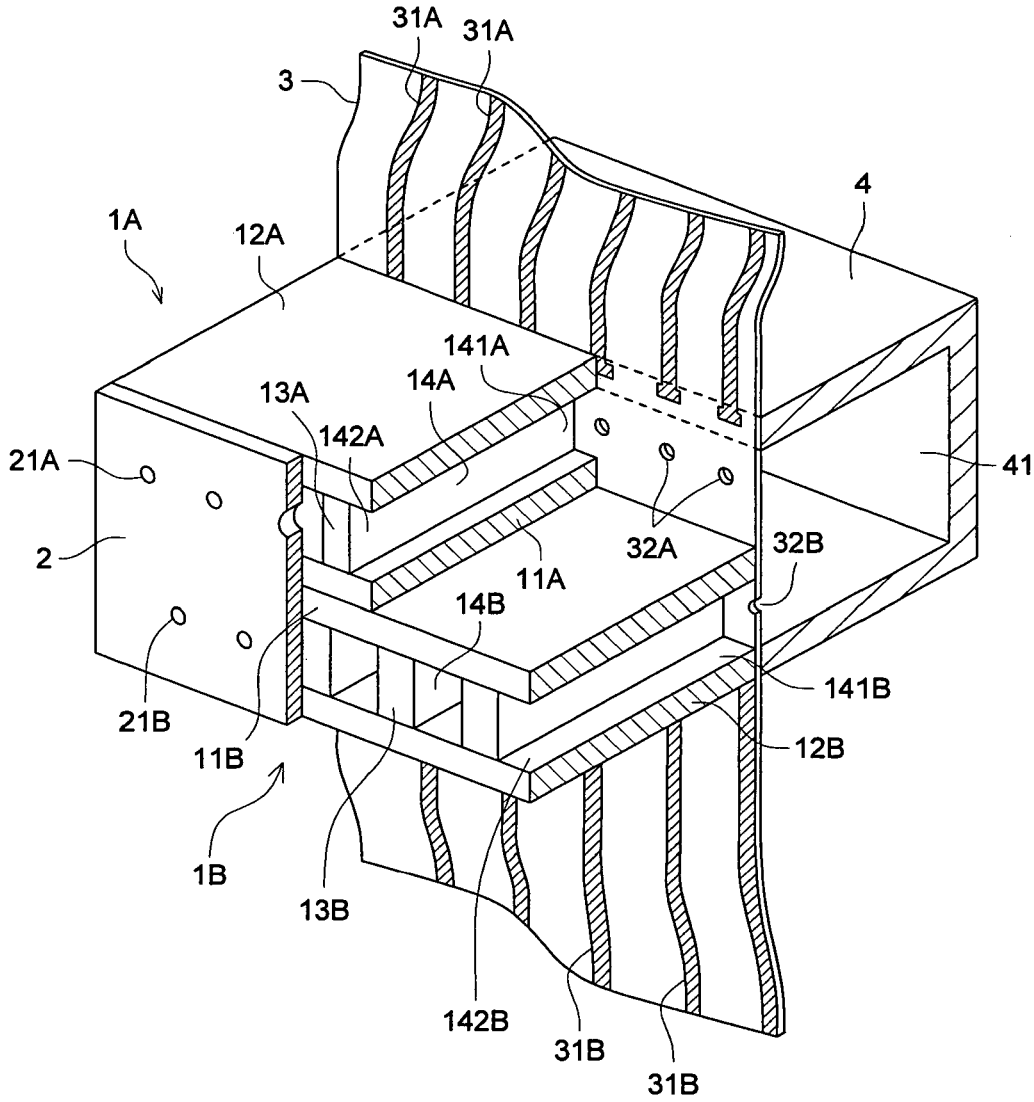
FIG. 1 is a perspective view in cross section of an example of an inkjet print head.

The following describes the embodiments according to the present invention with reference to drawings:

FIG. 1 is a perspective view in cross section of an example of an inkjet print head. In FIG. 1, 1A and 1B denote head chips, and 2 indicates a nozzle plate connected to the front surface of the head chips 1A and 1B. Numeral 3 shows a flexible wiring board with aperture connected to the back surface of the head chips 1A and 1B, and 4 denotes an ink manifold connected opposite to each of the head chips 1A and 1B in the flexible wiring board 3.

In this specification, the "front surface" refers to the surface on the side where an ink droplet is ejected from the head chip (ink channel), and the "back surface" refers to the surface on the opposite side. The upper and lower outer surfaces in the drawing sandwiching the channels arranged in parallel in the head chip are called "top surface" and "bottom surface", respectively.

Figure 2:
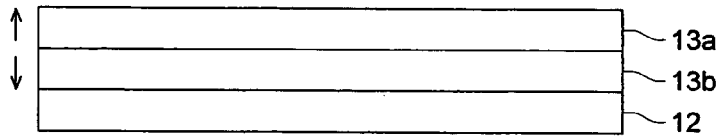
FIGS. 2(*a*), 2(*b*), 2(*c*) and 2(*d*) are drawings showing a head chip manufacturing processes.
Figure 2:
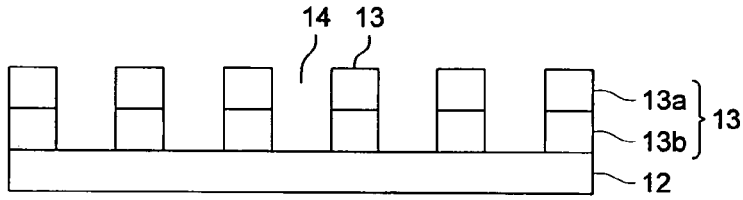
Figure 2:
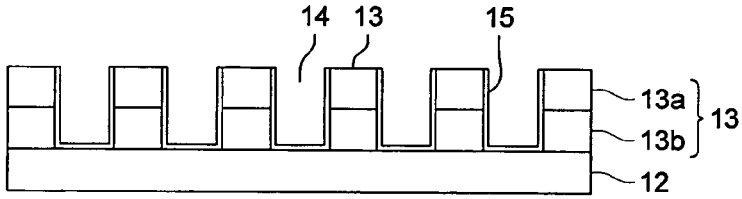
Figure 2:
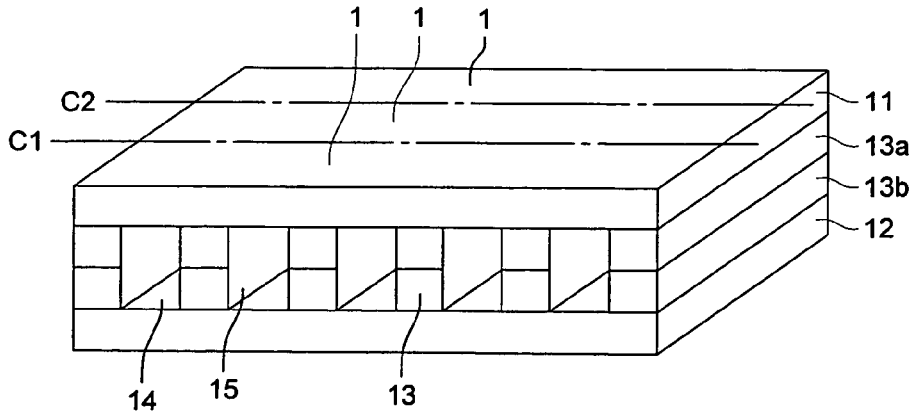
Figure 3:
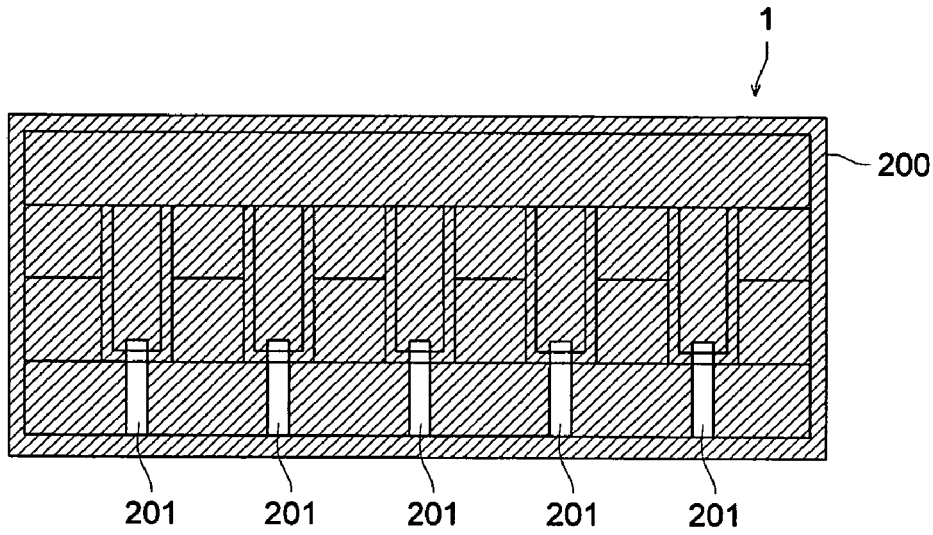
FIGS. 3(*a*) and 3(*b*) are drawing representing a process of forming connection electrodes on a head chip by photo-lithography.
Figure 3:
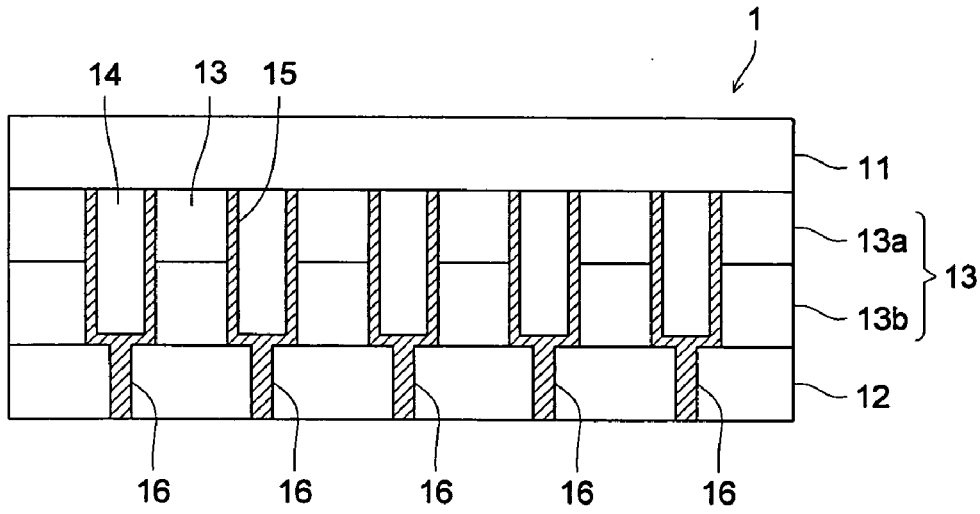
Figure 4:
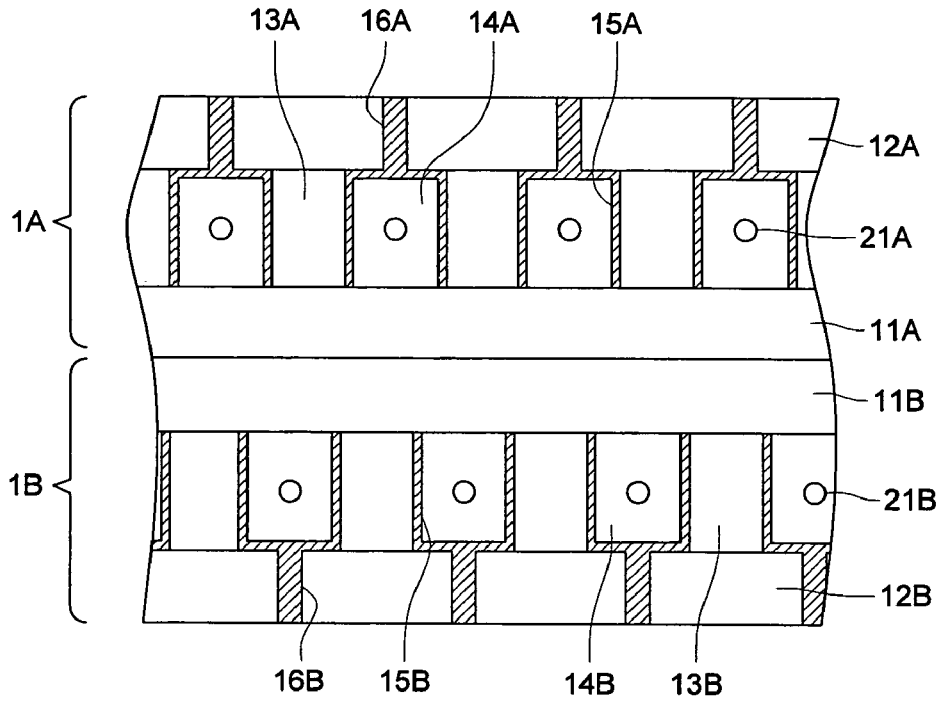
FIG. 4 is a rear view of the structure of stacked head chips.

The following describes the method for manufacturing a head chip 1 with reference to FIGS. 2 through 4.

In the first place, two piezoelectric device substrates 13*a* and 13*b* are bonded onto the lower substrate 12 (FIG. 2(*a*)). A commonly known piezoelectric device material that is deformed by application of voltage can be used as a material of the piezoelectric device used in the piezoelectric device substrates 13*a* and 13*b*. Especially use of a lead zirconate titanate (PZT) is preferred. Two piezoelectric device substrates 13*a* and 13*b* are bonded so that the respective directions of polarization (indicated by an arrow mark) are opposite to each other, and are also bonded onto the lower substrate 12 using an epoxy adhesive.

Then a plurality of parallel channels are ground throughout the two piezoelectric device substrates 13*a* and 13*b*, using a dicing blade. Thus, drive walls 13 are arranged in parallel across the height on the lower substrate 12, drive walls 13 being characterized by polarization oriented in the opposite directions. Each channel is ground to almost a constant depth from one end of the piezoelectric device substrates 13*a*. and 13*b* to the other end. This arrangement provides a straight ink channel 14 having the same width and depth in the longitudinal direction (FIG. 2(*b*)). Since these two PZT wafers are polarized in the opposite direction, and therefore all the drive walls 13 formed by these piezoelectric device substrates 13*a* and 13*b* are subjected to the chevron type shear mode deformation with high efficiency. This provides a high pressure to ink in the ink channel, a high speed to the ink droplets from a nozzle and minimizes the deviation of printed dot position, with the result that image quality is improved.

It is also possible to make the following arrangements (not illustrated): Instead of using the lower substrate 12, the piezoelectric device substrate 13*b* is formed to have a greater thickness, and a plurality of parallel channels are ground in the area spanning from the side of the thinner piezoelectric device substrate 13*a* to a midpoint of the piezoelectric device substrate 13*b*. The lower substrate is integrally formed simultaneously with the formation the drive walls 13 where polarization is oriented in the opposite directions across the height.

Then a drive electrode 15 is formed on the internal surface of the each of the ink channels 14 formed in this procedure. The metal forming the drive electrode 15 can be Ni, Co, Cu, Al and others. Use of Al on Cu is preferred from the viewpoint of electrical resistance. However, Ni is preferably used from the viewpoint of corrosion, strength and cost.

One of the methods for producing the drive electrode 15 is to form a metallic film using a vacuum apparatus as in the methods of vapor deposition, sputtering, plating and chemical vapor deposition (CVD). Of these, the plating method is preferably used. Electroless plating method is preferred in particular. Electroless plating method allows a uniform and pinhole-free metallic film to be formed. The preferred range of the thickness of plated metal is 0.5 through 5 microns.

The drive electrode 15 must be provided independently for each ink channel 14. Thus, it is inevitable to ensure that metallic film is not plated on the top surface of the drive wall 13. Accordingly, a dry film is laminated on the top surface of each of the drive walls 13 in advance to form a resist exposed photolithographically, and is lift off after formation of a metallic film. This procedure allows the drive electrodes 15 to be formed on the side surface of each drive wall 13 and on the bottom surface of each ink channel 14 on a selective basis (FIG. 2(*c*)).

After formation of the drive electrode 15 in the aforementioned manner, an upper substrate 11 is bonded on the top surface of the substrate where the drive wall 13 and ink channel 14 are arranged in parallel, using an adhesive. If the same substrate material as the piezoelectric material constituting the drive wall 13 is depolarized and used on the upper substrate 11 and lower substrate 12, then it is possible to avoid curvature and deformation of the whole print head that may result from the difference in thermal expansion coefficient due to the adverse effect of the heat during the bonding operation. That is, the bonding operation is done with a high temperature and a high pressure.

This assembled head tip is then cut along the cut lines C1, C2, etc. in the direction orthogonal to the longitudinal direction of the ink channel 14. This step allows a plurality of head chips to be formed in one operation from one assembled head tip formed by bonding the upper substrate 11, piezoelectric device substrates 13*a* and 13*b* and lower substrate 12, these head chips having the front surface and back surface located face to face with each other (FIG. 2(*d*)). The cut lines C1, C2, etc. determine the active drive length of the ink channel 14 of the head chips 1, . . . produced therefrom, and are determined as appropriate depending on the drive frequency and/or droplet size, in conformity to conforming to this drive length.

The aforementioned procedure permits the head chip 1 to have drive wall 13 and ink channel 14 arranged alternately between the upper substrate 11 and lower substrate 12. The ink channel 14 is so configured that the walls on both sides are oriented in the perpendicular direction and are parallel to each other. As shown in FIG. 1, the outlets 142A and 142B, and inlets 141A and 141B of the ink channels 14A and 14B are arranged on the front and back surfaces of the head chips 1A and 1B. The ink channels 14A and 14B are designed in a straight type structure wherein the width and depth are the same size in the longitudinal direction from the inlets 141A and 141B to the outlets 142A and 142B.

As shown in FIG. 3(*a*), a photosensitive dry film 200 is laminated on one surface (back surface) of the cross section of the head chip 1, and the film 200 is exposed to make openings 201. These openings 201 being provided in the area ranging from the portion of the drive electrode 15 formed on the bottom surface of the ink channel 14 to the end face (back end face) of the lower substrate 12. When aluminum or the like is subjected to vapor deposition and the dry film is lifted off, then metallic film is left only inside the openings 201. This is used as a connection electrode 16. The connection electrode 16 can be formed by sputtering instead of vapor deposition.

When the dry film 200 has been removed, the connection electrode 16 for electrical connection with the drive electrode 15 is pulled out of each ink channel 14 onto one surface of the head chip 1, independently for each ink channel 14, as shown in FIG. 3(*b*).

Another way of forming the aforementioned connection electrode 16 is to form it simultaneously with the drive electrode 15. To be more specific, in the method of forming a head chip 1 shown in FIG. 2. A metallic film for a drive electrode and connection electrode is formed simultaneously, by electroless plating, on all the surfaces of the head chip including the inner surface of each ink channel 14. Then the unwanted portion of the metallic film deposited on all the surfaces of the head chip 1 is removed by a laser beam in such a way that patterning is implemented. The metallic film is separated and made independent for each ink channel 14, whereby each drive electrode 15 and each connection electrode 16 electrically connected thereto are formed simultaneously. This method allows a metallic film to be formed only in one operation, and therefore simplifies the production process. Further, the connection electrode requires use of only the back surface of the head chip 1. This arrangement minimizes the possibility of failure caused by contact with a plurality of corners.

The connection electrode 16 should be pulled out onto either the upper substrate 11 or lower substrate 12 on the back surface of the head chip 1. In this case, the connection electrode 16 is pulled out onto the side of the lower substrate 12. This is because the connection electrode 16 can be pulled out using the portion of the drive electrode 15 formed on the bottom surface of the ink channel 14. This arrangement allows the width of the connection electrode 16 to be formed equal to or smaller than that of the ink channel 14, and eliminates the possibility of an electrical short-circuit between the adjacent connection electrode 16. Thus, this arrangement is preferably used. The electrode can also be pulled out onto the side of the upper substrate 11. In this case, the electrode should be pulled out using the side of the ink channel 14 in the drive electrode 15, preferably the portion formed on both sides.

As shown in FIG. 4, two head chips 1 manufactured in this procedure are bonded using the adhesive, whereby a bonded head chips 1A and 1B having two rows of ink channels is obtained. FIG. 4 is a rear view of the bonded head chips 1A and 1B.

When adhesive is used to bond the upper substrates 11A and 11B together, the head chips are stacked in two layers in vertical direction orthogonal to the direction where the ink channels 14A and 14B are arranged. This leads to formation of two rows of ink channels composed of a row of ink channels 14A and a row of ink channels 14B. In this case, the connection electrodes 16A and 16B of the head chips 1A and 1B are pulled out so that they are located opposite to each other. In the head chips 1A and 1B, the centerline of ink channels 14A and 14B are biased half pitch of a nozzle distance.

As shown in FIG. 1, a nozzle plate 2 covering the head chips 1A and 1B is bonded on the front surface of the head chips 1A and 1B. A nozzle 21A corresponding to the ink channel 14A of the head chip 1A and a nozzle 21B corresponding to the ink channel 14B of the head chip 1B are provided through the nozzle plate 2.

The flexible wiring board 3 is formed to have almost the same width as the width of the head chips 1A and 1B (length in the direction in which the ink channels 14A and 14B are arranged). Drive wires 31A and 31B, which are formed on one of the surfaces thereof, are electrically connected with the connection electrodes 16A and 1.6B respectively, corresponding to the ink channels 14A and 14B of the head chips 1A and 1B, pulled out of the ink channels 14A and 14B. This arrangement forms drive wires 31A and 31B, which is used to apply the signal voltage supplied from the drive circuit (not illustrated), to the drive electrodes 15A and 15B in each of the ink channels 14A and 14B. One of the methods for forming the drive wires 31A and 31B is to form a metallic film using a vacuum apparatus as in the methods of vapor deposition, sputtering, chemical vapor deposition (CVD), and plating without the present invention being restricted thereto.

As shown in FIG. 4, the connection electrodes 16A and 16B are pulled out in the opposite directions between the bonded adjacent head chips 1A and 1B. On the flexible wiring board 3, the drive wire 31A for the head chip 1A is pulled out in the upward direction, while the drive wire 31B for the head chip 1B is pulled out in the downward direction. This configuration makes it possible to increase the pitch of the drive wires 31A and 31B corresponding to the head chips 1A and 1B, respectively, with the result that the possibility of electric short-circuit between adjacent wires is avoided.

On the flexible wiring board 3, an ink feed aperture 32A corresponding to the inlet 141A of each ink channel 14A of the head chip 1A, and an ink feed aperture 32B corresponding to the inlet 141B of each ink channel 14B of the head chip 1B are provided in the same number as that of the ink channels 14A and 14B. When brought in contact with the back surface of the head chips 1A and 1B, these ink feed apertures 32A and 32B allow ink to flow into the ink channels 14A and 14B through them.

The ink feed apertures 32A and 32B are formed before the flexible wiring board 3 is bonded to the back surface of the head chips 1A and 1B. If a laser beam is used to form the ink feed apertures 32A and 32B after the flexible wiring board 3 has been bonded, then the neighboring area close to the inlet of the ink channel 14 is exposed to the laser beam, and this may be partially damaged the ink channel 14. This problem can be solved by forming the ink feed apertures 32A and 32B before bonding the flexible wiring board 3 to the head tip.

When a flexible printed circuit board (FPC) is used as the flexible wiring board 3, ink feed apertures 32A and 32B can be easily formed. At the same time, this will provide a higher degree of freedom in the direction in which the drive electrode is pulled out of the head chips 1A and 1B. Further, this method also ensures a compact structure of the inkjet print head itself. FIG. 1 shows an example of the FPC used as the flexible wiring board 3.

A laser beam can be used to form the ink feed apertures 32A and 32B on the flexible wiring board 3. However, when the FPC is used as the flexible wiring board 3, cutting dies are preferably used to form them. In particular, the ink feed apertures 32A and 32B does not require such high precision processing in geometric configuration and position as that in the case of forming the nozzles 21A and 21B of the nozzle plate 2. Accordingly, use of a cutting dies also ensures formation of the ink feed apertures 32A and 32B at a lower cost in a short period of time. Use of a laser beam requires higher running costs and longer processing time since all ink channels cannot be processed in one operation. Thus, use of the cutting dies is preferred especially in the case of forming a large number of apertures.

The ink feed aperture can be arranged in the following configurations: The ink feed apertures are provided for all ink channels in a one-to-one relationship. One ink feed aperture is provided to be shared by a row of ink channels (one aperture for a row of ink channels). One ink feed aperture is provided for adjacent multiple ink channels out of a row of ink channels. One large ink feed aperture is provided for all the multiple rows of ink channels when multiple rows of ink channels are arranged. As shown in the drawing, however, if the ink feed apertures 32A and 32B are provided for the ink channels 14A and 14B in a one-to-one relationship, and the area is smaller than the opening area of the inlets 141A and 141B of the ink-channels 14A and 14B, then the flexible wiring board 3 can be used as a flow path regulater that regulates the amount of ink flowing into and out of the ink channels 14A and 14B. Further, this aperture ensures easy ink meniscus control and eliminates the need of separately installing a new flow path regulating board. This flexible wiring board 3 has three functions, that is feed drive signal to the print head and close the back end of the ink channel, and regulate the ink flow into the ink channel. At the same time, reduction in the number of parts and simplification of the structure are provided by this preferred method of arrangement.

Figure 5:
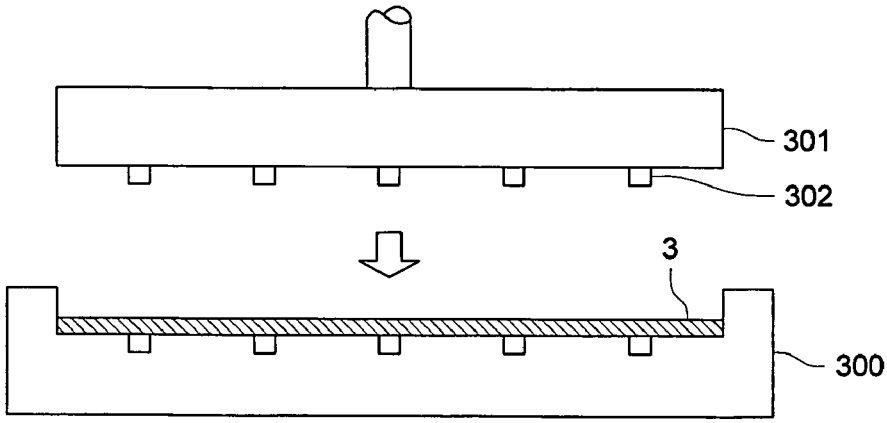
FIG. 5 is drawing showing a method for forming an ink feed aperture by stamping.

To form multiple ink feed apertures 32A and 32B on one flexible wiring board 3 using cutting dies, a flexible wiring board 3 is set inside the cutting dies 300, for example, as shown in FIG. 5. Pressing is performed by a convex die 301 containing multiple convex portions for opening a through-hole aperture serving as an ink feed aperture. This method can provide effective formation of multiple ink feed apertures in one operation.

The shape of the ink feed apertures 32A and 32B is not restricted to the circular form as illustrated. These apertures can be designed in any other form such as a rectangular form.

The flexible wiring board 3 may incorporates a drive IC in advance, although not illustrated.

When the ink feed apertures 32A and 32B are preferably formed on the flexible wiring board 3 in a one-to-one relationship with ink channels 14A and 14B, easy alignment between the drive wires 31A and 31B and ink feed apertures 32A and 32B is ensured if the drive wires 31A and 31B are formed after the ink feed apertures 32A and 32B have been formed.

The flexible wiring board 3 having the drive wires 31A and 31B and ink feed apertures 32A and 32B formed thereon in the aforementioned procedure is bonded over the back surfaces of the head chips 1A and 1B using an anisotropic conductive film, in such a way that the drive wires 31A and 31B correspond to the connection electodes 16A and 16B on the back surfaces of the head chips 1A and 1B, and the ink feed apertures 32A and 32B correspond to the inlets 141A and 141B of the ink channels 14A and 14B. As shown in the present embodiment, even if the head chips 1A and 1B are bonded in multiple layers to form a plurality of rows of ink channels, one flexible wiring board 3 can be used for common use, and therefore, the number of parts can be reduced. Moreover, a wiring pattern for applying signal voltage to a plurality of head chips can be formed on one flexible wiring board 3 in one operation, whereby the manufacturing process is simplified.

Further, since the flexible wiring board 3 is mounted on the back surfaces of the head chips 1A and 1B, the connection electrodes 16A and 16B for electrical connection with the ink feed apertures 32A and 32B of the flexible wiring board 3 are required only to be pulled out to the back surfaces of the head chips 1A and 1B. This arrangement reduces the length of the wiring and hence electrical resistance, as compared to the arrangement where connection electrodes 16A and 16B must be pulled out onto the top or bottom surfaces of the head chip. The connection electrodes 16A and 16B are electrically connected with the drive wires 31A and 31B of the flexible wiring board 3 on the back surfaces of the head chips 1A and 1B, through only one corner from the inlets 141A and 141B of the ink channels 14A and 14B. This configuration reduces the possibility of wire disconnection and improves the reliability in electrical connection.

One ink manifold 4 shared by head chips 1A and 1B is bonded by an adhesive on the surface opposite to the head chips 1A and 1B, in such a way as to sandwich the aforementioned flexible wiring board 3 in-between. An ink supply chamber 41 is formed inside the ink manifold 4. Ink in the ink supply chamber 41 is fed into each of the ink channels 14 through the ink feed apertures 32A and 32B. The inkjet print head shown in FIG. 1 is now constructed.

The flexible wiring board 3 can be connected with the head chips 1A and 1B as follows: The flexible wiring board 3 is connected integrally with the ink manifold 4 in advance. This ink manifold 4 integrated with the flexible wiring board 3 is bonded on the back surface of the head chips 1A and 1B.

When the ink manifold 4 is made of synthetic resin, the flexible wiring board 3 can be attached into one piece at the time of molding. In this case, the following method can be used: The flexible wiring board 3 comprising the drive wires 31A and 31B and ink feed apertures 32A and 32B is bonded to a forming die for molding the ink manifold 4, and melted resin is poured, thereby achieving integration into one piece.

Figure 6:
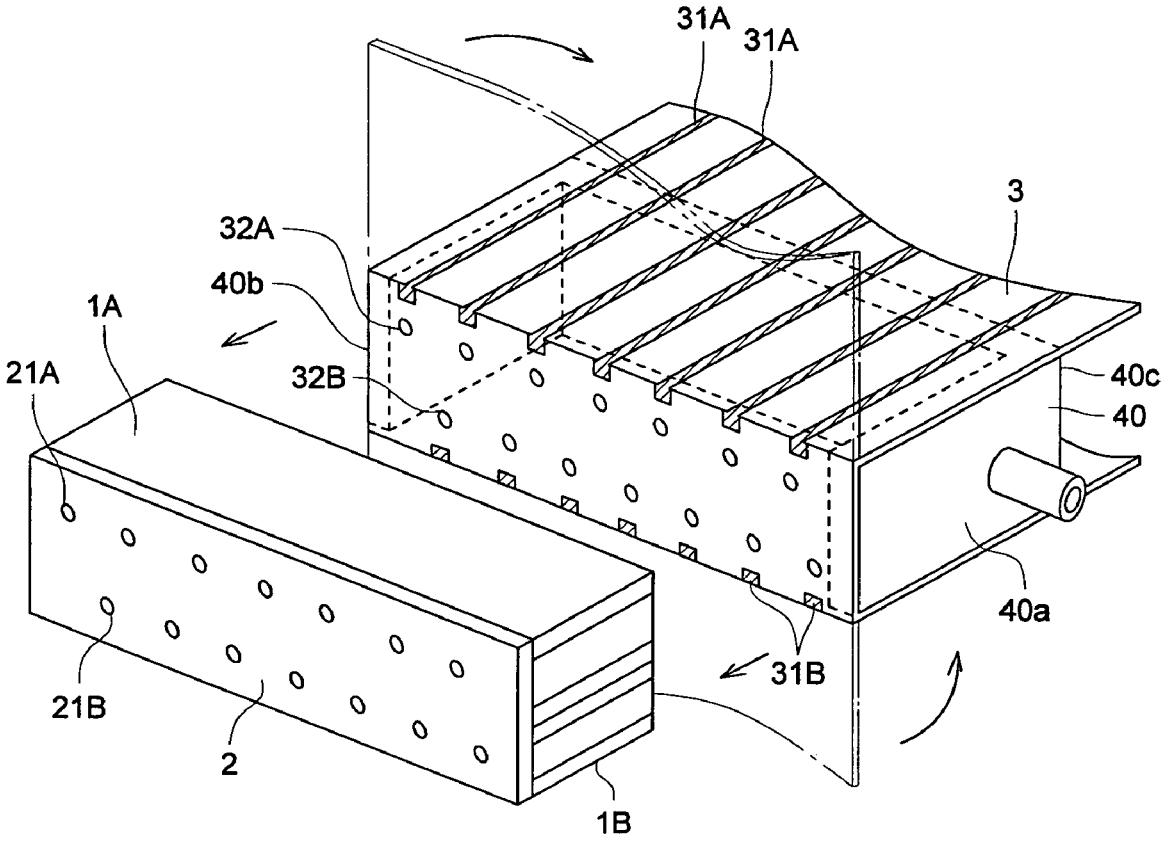
FIG. 6 is a partially exploded perspective view showing an example of forming a wall surface of an ink manifold using a flexible wiring board with aperture.

The ink manifold is commonly formed in a box type structure wherein only one surface arranged opposite to the head chips 1A and 1B is opened. However, when FPC is used as the flexible wiring board 3, a U-shaped (as viewed from the plane) wall member 40 is utilized, the wall member 40 being composed of three walls of double side walls 40*a* and 40*b* and back wall 40*c*, as shown in FIG. 6. After the leading edge surfaces of both double side walls 40*a* and 40*b* of the wall member 40 have been connected with the flexible wiring board 3 composed of FPC, both ends of the flexible wiring board 3 are bent to the side opposite to the head chips 1A and 1B, to be connected with the upper and lower surfaces of the double side walls 40*a* and 40*b* and back wall 40*c*, respectively. In this manner, the ink manifold can be composed of the wall member 40 and flexible wiring board 3. To put it another way, the flexible wiring board 3 constitutes two wall surfaces on the top and bottom of the ink manifold. This arrangement is preferably used since it provides a simplified structure of the ink manifold. The wall surface of the ink manifold constructed by the flexible wiring board 3 in the aforementioned procedure is not restricted to two walls: the one-wall construction can be utilized when the flexible wiring board 3 is pulled out in one direction—either upward or downward,—as in the case where one head chip is provided.

In the aforementioned configuration, after the flexible wiring board 3 has been connected with the wall member 40, the integrated member can be connected on the back surface of the head chips 1A and 1B, as shown in FIG. 6. Alternatively, the flexible wiring board 3 can be bent after having been connected with the back surface of the head chips 1A and 1B, and can be bonded with the wall member 40.

The resin material used to manufacture the ink manifold 4 and wall member 40 preferably has the coefficient of thermal expansion close to that of the piezoelectric material used to manufacture the head chips 1A and 1B. Such a material includes the liquid crystal polymer having a controllable coefficient of thermal expansion, the resin material loaded with a great amount of inorganic filler, and the resin material called the nano-composite. The difference in the coefficient of thermal expansion from that of the piezoelectric material used to manufacture the head chips 1A and 1B is preferably equal to or smaller than 10 ppm, more preferably equal to or smaller than 3 ppm.

Figure 7:
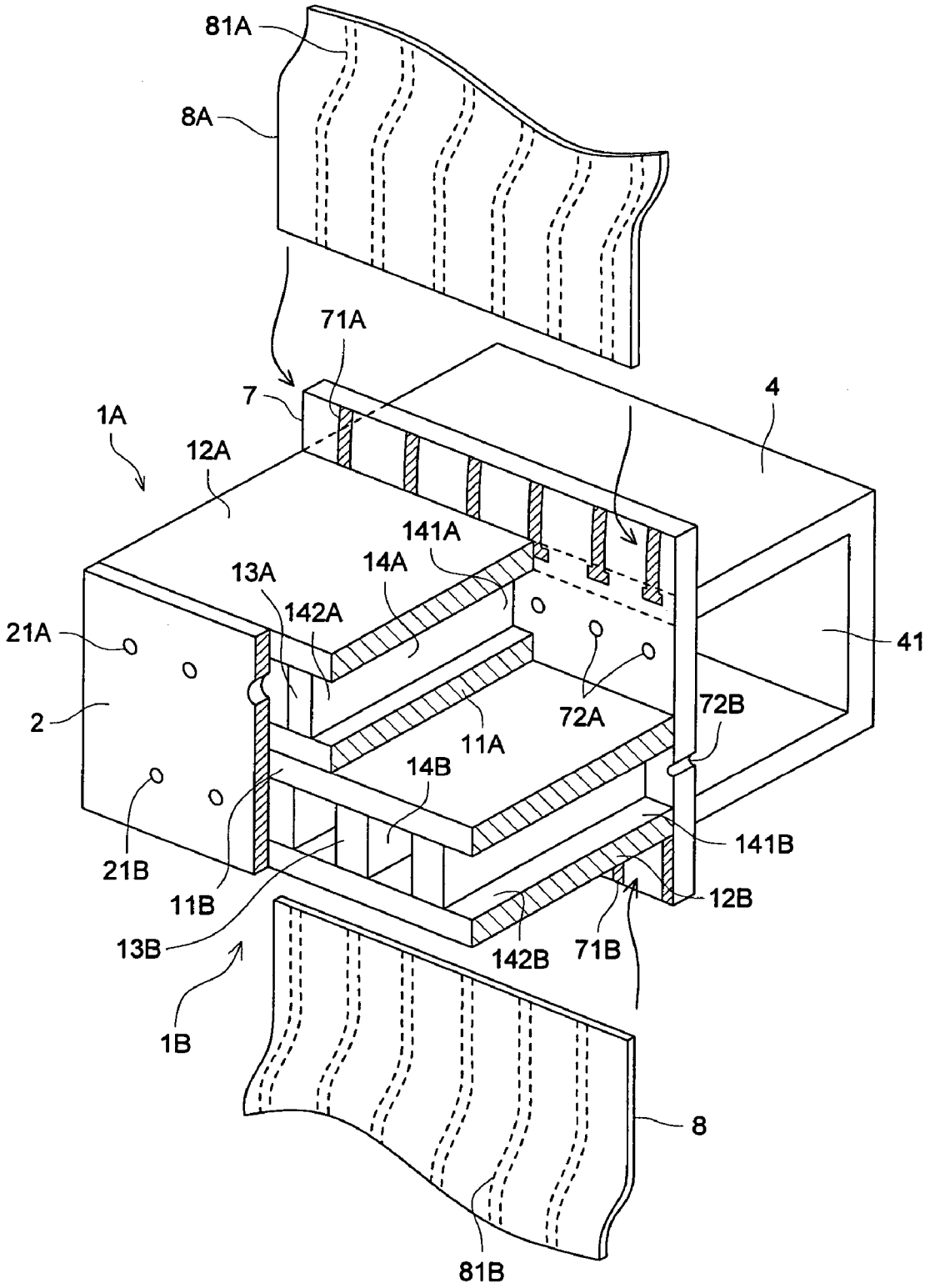
FIG. 7 is perspective view in cross section representing another example of an inkjet print head.

Also, the flexible wiring board can be manufactured using a photosensitive glass substrate, without being restricted to the aforementioned PFC. FIG. 7 is a cross sectional view showing an example of the inkjet print head containing a flexible wiring board made of photosensitive glass substrate. The portions assigned with the same numerals of reference as those in FIG. 1 have the same configuration, and will not be described in details to avoid duplication.

In FIG. 7, the numeral 7 denotes a flexible wiring board composed of a photosensitive glass substrate. It has almost the same width as the head chips 1A and 1B (length of the direction where the ink channels 14A and 14B are arranged), and the thickness slightly greater than that of the head chips 1A and 1B. The top and bottom ends thereof are bonded in such a way as to be slightly overhang the top and bottom of the stacked head chips 1A and 1B.

The drive wires 71A and 71B for electrical connection with the connection electrodes 16A and 16B (see FIG. 4) pulled out onto the back surface of the head chips 1A and 1B are pattern-formed on the connection surface of the driver circuit 7 to be connected with the head chips 1A and 1B. At the same time, ink feed apertures 72A and 72B are formed at the positions corresponding to the inlets 141A and 141B of the ink channels 14A and 14B.

The photosensitive glass substrate is defined as a substrate composed of photosensitive glass containing Ce (cerium oxide) as a photosensitive metallic component such as Ag, Au or Cu and a sensitizer. If exposure is performed by applying ultraviolet rays to this photosensitive glass substrate, the photosensitive metallic component of the exposed portion changes into metal atom. Namely, the following photoelectronic reaction takes place:

$$Ce^{3+} \rightarrow Ce^{4+} + e^{-}$$

Some of the photoelectrons discharged from the $Ce^{3+}$ ion are captured by the photosensitive ion $Me^{+}$. Then the following reaction occurs:

$$Me^{+} + e^{-} \rightarrow Me$$

After the aforementioned reaction, heat treatment is provided. Then the aforementioned metal atoms Me get together, and metal colloid is generated. This metal colloid is formed into a crystal nucleus, and the crystal phase is deposited. The crystallized portion and other glass portions have different dissolution speeds with respect to etching solution. The crystallized portions dissolve more quickly. It is possible to control the position where the first photoelectron reaction of $Ce^{3+}$ ion occurs. Accordingly, when exposure is carried out on a selective basis using a photomask on the top surface of the photosensitive glass FIGS. 8(*a*) through (*d*) show a process of manufacturing a rigid wiring board 7.

Figure 8:
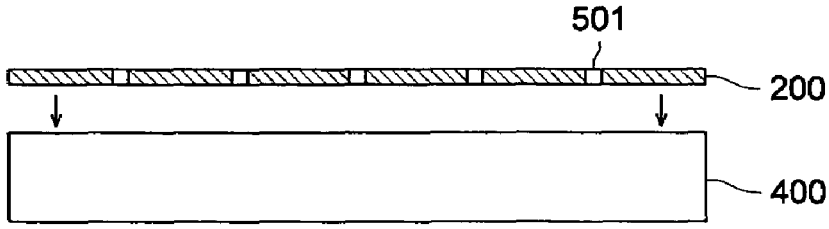
FIG. 8(*a*) is drawing representing the process of forming a flexible wiring board using a photosensitive glass substrate.
Figure 8:
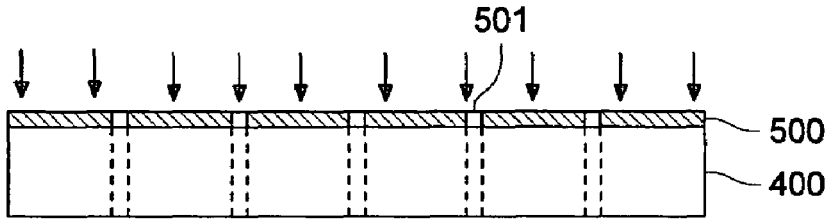
Figure 8:
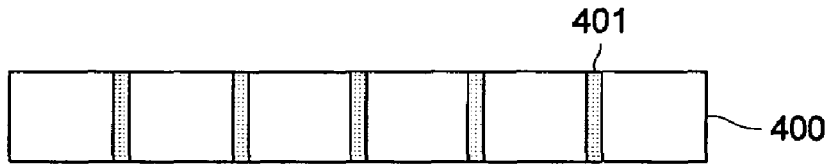
Figure 8:
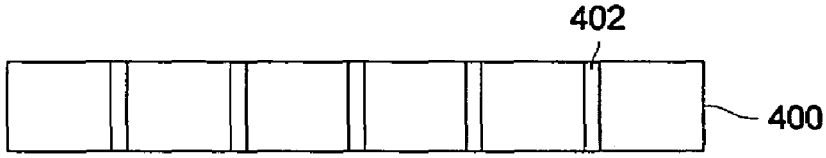

A photosensitive glass substrate 400 of a predetermined size for producing a rigid wiring board 7 is prepared, as shown in FIG. 8(*a*). A photomask 500 for forming the through-holes of ink feed apertures 72A and 72B is mounted on the top surface thereof. Then ultraviolet rays are applied, as shown in FIG. 8(*b*).

The photomask 500 is provided with an opening 501, having the same pitch as those of the ink channels 14A and 14B of the head chips 1A and 1B, for forming a through-hole. This photomask 500 can be used without any restriction if selective exposure is allowed. For example, it is possible to use a lightproof film such as a chromium film that is pattern-formed, except for the opening 501, wherein this lightproof film ensures that ultraviolet rays do not pass through a transparent glass sheet metal.

Ultraviolet rays are applied to the photosensitive glass substrate 400 through only the opening 501 of the photomask 500. Accordingly, a crystallized portion 401 is formed across the thickness of the photosensitive glass substrate 400 only at the portion corresponding to the opening 501, as shown in FIG. 8(*c*), on the photosensitive glass substrate 400 by the application of ultraviolet rays.

In the next step, the photosensitive glass substrate 400 provided with the aforementioned processing of exposure is heat treated. Heat treatment is provided to change the metal atom generated by exposure in the photosensitive glass substrate 400, into metal colloid. It is different from usual baking. Accordingly, it is insufficient that heat treatment is carried out at a temperature intermediate between the glass transition temperature and yield temperature used in the photosensitive glass substrate 400, and this temperature is preferably used. If this temperature is lower than the glass transition temperature, the effect of heat treatment will not be sufficient. If this temperature is higher than the yield temperature, shrinkage is caused by heat, and dimensional accuracy will be adversely affected. Generally, the preferred temperature is from 450 through 600° C. Preferred time duration for heat treatment is 30 minutes through five hours.

In the subsequent step, the photosensitive glass substrate 400 heat treated in this manner is dipped into an etchant bath. Etching is applied only to the crystallized portion 401 subjected to exposure. An aqueous solution of hydrofluoric acid such as a dilute hydrofluoric acid is preferably used as etchant. The aforementioned processing of etching allows only the crystallized portion 401 to be dissolved and removed from the photosensitive glass substrate 400 on a selective basis. Then through-holes 402 are formed, as shown in FIG. 8(*d*). These through-holes 402 are used as ink feed apertures 72A and 72B.

The photosensitive glass substrate 400 is used to form the through-hole 402 on a selective basis by the aforementioned processes of exposure, heat treatment and etching, as described above. These through-holes 402 are used as ink feed apertures 72A and 72B. This procedure allows the ink feed apertures 72A and 72B to be formed to a high precision in one operation, with the result that time for processing the ink feed apertures 72A and 72B is reduced, and easier processing and lower processing costs are ensured.

After the through-holes 402 serving as ink feed apertures 72A and 72B have been formed on the photosensitive glass substrate 400, the drive wires 71A and 71B are pattern-formed on one surface of the photosensitive glass substrate 400 at a pitch corresponding to the connection wires 16A and 16B of the head, chips 1A and 1B. The drive wires 71A and 71B can be formed by selective formation of a metallic film using a method of vapor deposition, sputtering, plating and others. For selective formation of a metallic film, a mask or resist (not illustrated) equipped with openings as the drive wires 71A and 71B is attached onto one surface of the photosensitive glass substrate 400 so that metallic film is formed on these openings alone.

Then the rigid wiring board 7 formed in the aforementioned procedure is connected to the back surface of the head chips 1A and 1B using an anisotropic conductive film, in such a way that the drive wires 71A and 71B are electrically connected with the connection wires 16A and 16B. In this case, the ends of the rigid wiring board 7 are located slightly overhang the top and bottom of the head chips 1A and 1B, as shown in FIG. 7. Accordingly, these end portions are connected with the FPCs 8A and 8B at a pitch corresponding to each of the drive wires 71A and 71B, wherein the FPCs 8A and 8B have the wires 81A and 81B pattern-formed thereon in advance. Then they are electrically connected with the drive circuit (not illustrated).

In the case of the rigid wiring board 7 using the photosensitive glass substrate, the ink feed apertures can be designed in a great variety of configurations. As illustrated, ink feed apertures are preferably provided for ink channels 14A and 14B in a one-to-one relationship, and each ink feed aperture is formed to have an area smaller than the opening area of each of the inlets 141A and 141B of the ink channels 14A and 14B. This arrangement allows the rigid wiring board 7 to be used also as a flow path regulating plate.

The aforementioned description has referred to the embodiment wherein two head chips are stacked one on top of the other to form two rows of ink channels. However, in the inkjet print head manufactured according to the present invention, a constituent member such as a flexible wiring board need not be connected to the head of either the upper substrate 11 or lower substrate 12 of each head chip, unlike the case of the prior art method. This allows still three or four head chips to be stacked in multiple layer onto the upper substrate 11 and lower substrate 12 using an adhesive. This provides easy formation of many rows of ink channels in multiple layers by increasing the number of the ink channels (i.e. the number of nozzles) in the direction orthogonal to the direction where ink channels are arranged, not in the direction where ink channels are arranged. To put it another way, this arrangement allows the one-dimensional configuration of multiple nozzles to be changed into the two-dimensional configuration of multiple nozzles, whereby a multi-color integral head is formed.

Figure 9:
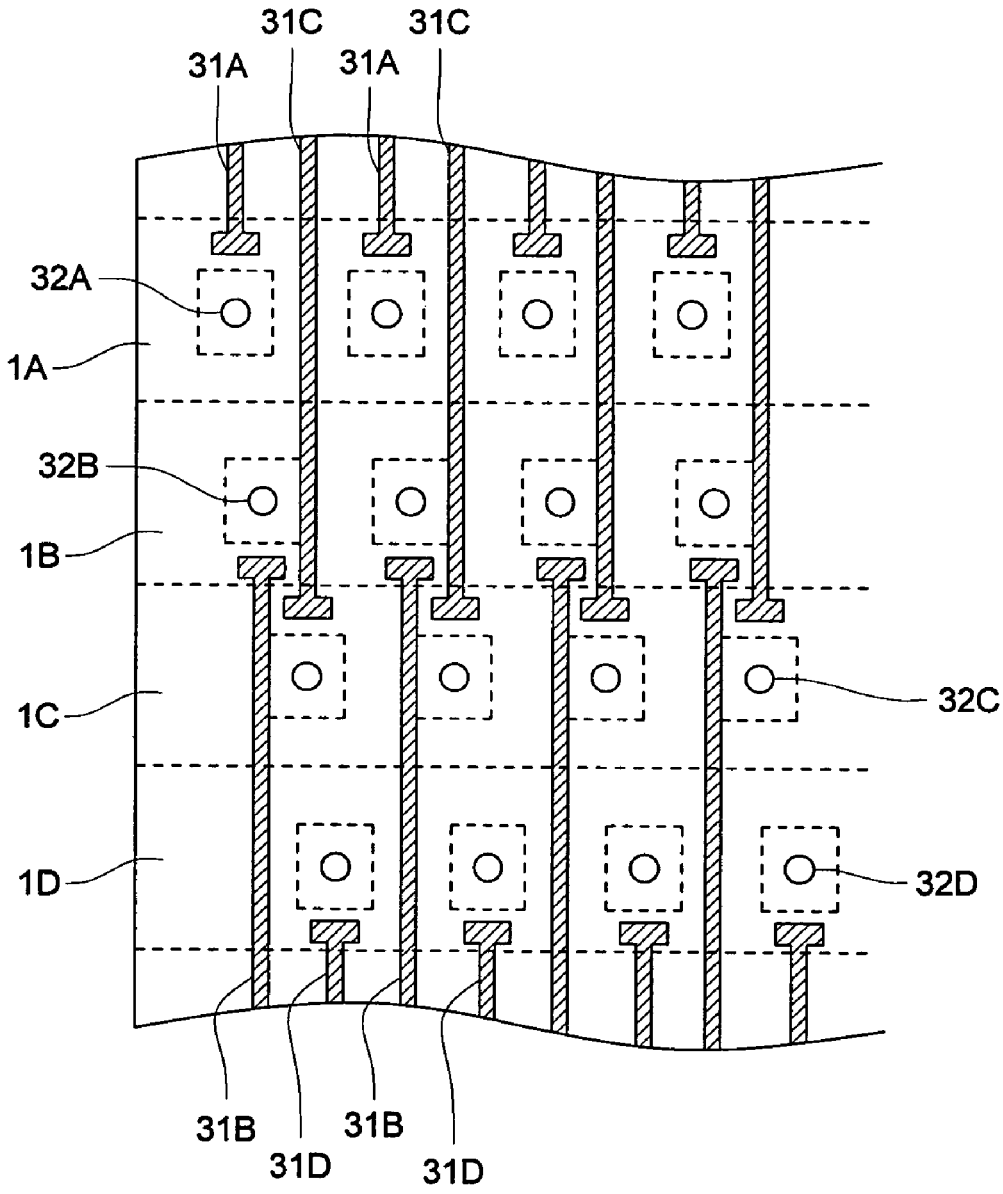
FIG. 9 is a drawing representing an example of the wiring pattern of a flexible wiring board with aperture.

As described above, even when still three or four head chips are stacked in multiple layers, drive wires corresponding to adjacent head chips are preferably formed using wiring board 3 or 7 in such a way that they are pulled out in the directions opposite to each other. For example, FIG. 9 shows the wiring pattern of the flexible wiring board 3 composed of the FPC when four head chips 1A through 1D are stacked in multiple layers. Here, the drive wires 31A and 31C for the head chips 1A and 1C as odd-numbered ones are pulled out upward in the drawing, and the drive wires 31B and 31D for the head chips 1B and 1D as even-numbered ones are pulled out downward in the drawing. Thus, a large pitch of the drive wires 31A through 31D formed on the flexible wiring board 3 can be ensured despite a further increase in the number of the stacked head chips, namely, the number of rows of the channel. In the drawing, 32A through 32D indicate ink feed apertures. They are manufactured in the numbers corresponding to those of the channels of each channel row.

When still three or four head chips are stacked in multiple layers, a laminated flexible substrate with drive wires formed in layers or a double-sided flexible substrate on the front and back surfaces can be used as the flexible wiring board, wherein the double-sided flexible substrate has a through-hole for communication with the front and back surfaces, together with a VIA hole embedded therein.

Figure 10:
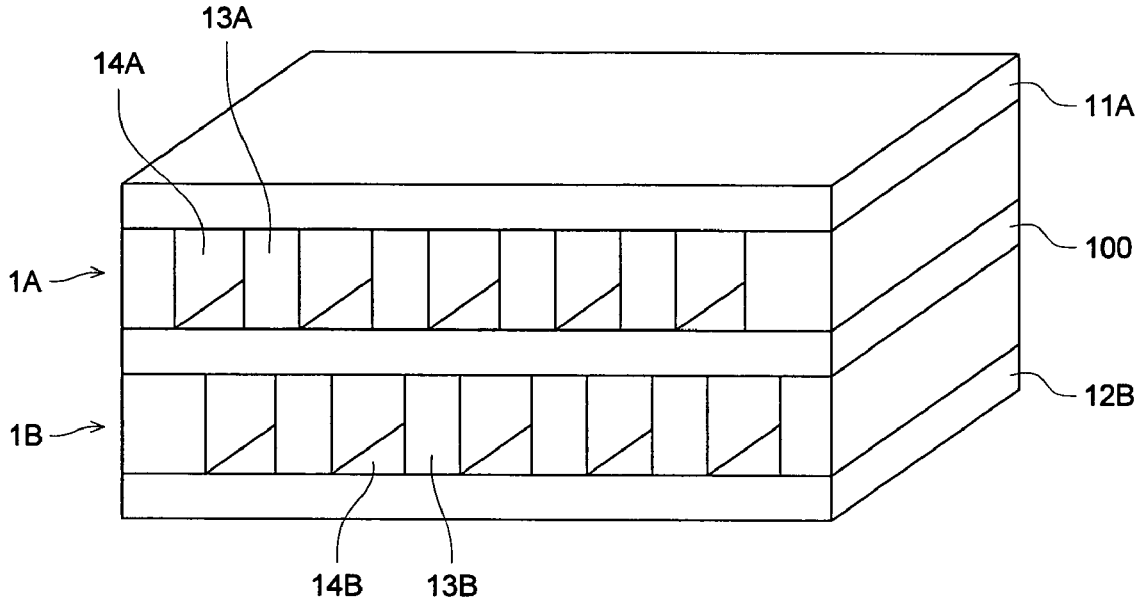
FIG. 10 is a perspective view showing another example of stacked head chips.

When head chips are stacked in multiple layers, a common member may be used as the upper and lower substrate bonded on the top and bottom. To take an example of the two-layer structure of head chips 1A and 1B for explanation, one common substrate 100 is used for the lower substrate of the head chip 1A and the upper substrate of the head chip 1B, as shown in FIG. 10. This arrangement provides downsizing of the inkjet print head and cost cutting.

Figure 11:
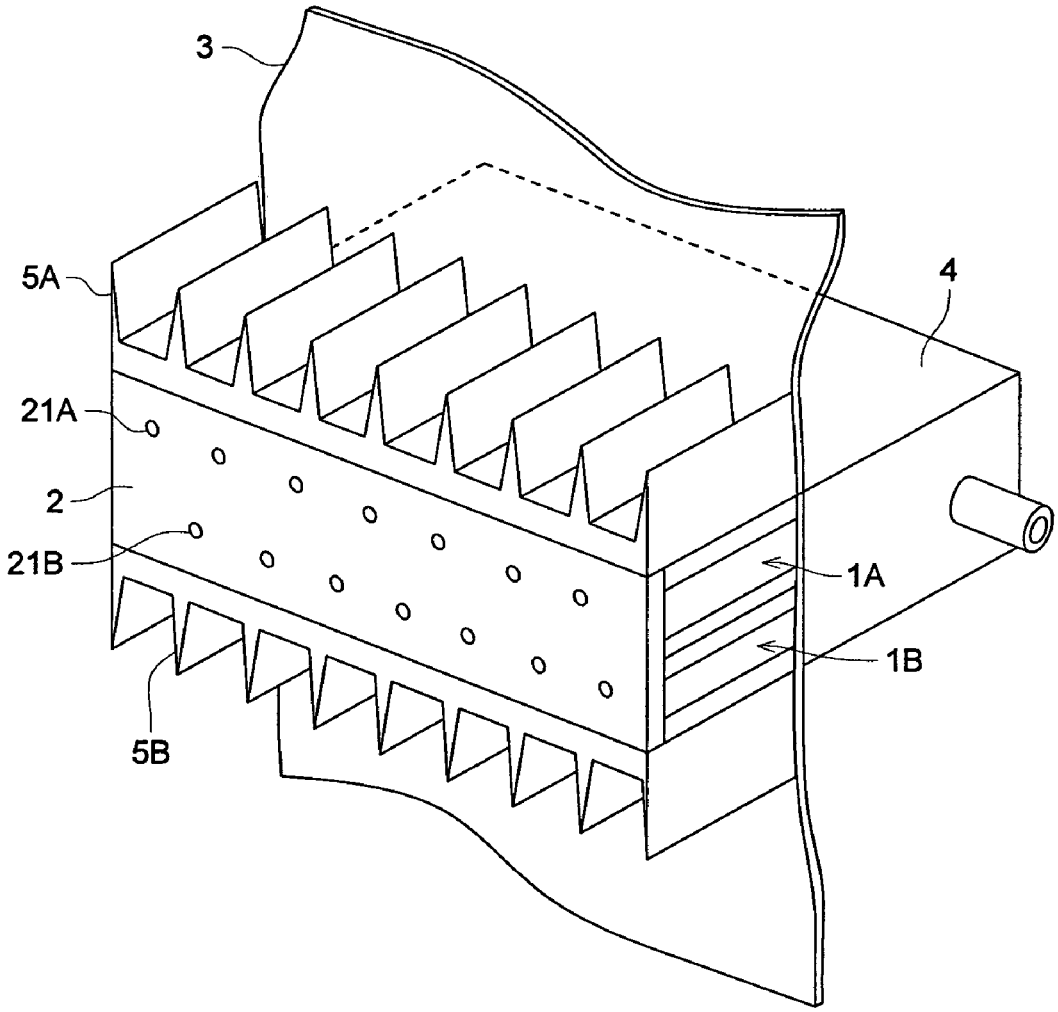
FIG. 11 is a perspective view showing an example of the inkjet print head equipped with a heat radiating member.

In the inkjet print head manufactured according to the present invention, free faces are formed on the surface (top surface) of the upper substrate 11 and the surface (back surface) of the lower substrate 12 of the head chip 1B, even when the head chips are stacked in two layers as 1A and 1B as shown in FIG. 1. These free faces provide easy heat radiation. FIG. 11 shows an example of heat radiation members 5A and 5B formed on these faces.

A heatsink can be preferably used as heat radiation members 5A and 5B. The head chips 1A and 1B serve to discharge the heat generated during high frequency drive, to the outside. The heat radiation members 5A and 5B are provided in the direction where the ink channels 14A and 14B of the head chips 1A and 1B are arranged. This configuration ensures efficient heat radiation throughout the ink channels 14A and 14B for both the head chips 1A and 1B.

In FIG. 11, the ink manifold 4 can be formed by bending the flexible wiring board 3 composed of the FPC backward, using a U-shaped (as viewed from the plane) wall member 40 shown in FIG. 6. Further, the rigid wiring board 7 composed of a photosensitive glass substrate can be used as the flexible wiring board.

To provide heat radiation measures when still three or four head chips are stacked in multiple layers, a heat radiation member such as a heatsink is preferably provided between head chips so that the heat radiation member is sandwiched by the upper and lower head chips. This arrangement allows a heat radiation member to be provided on each of the top and bottom surfaces of the head chip. In the intermediate head chip with head chips placed on the top and bottom thereof, heat radiation can be applied to all channels.

Figure 12:
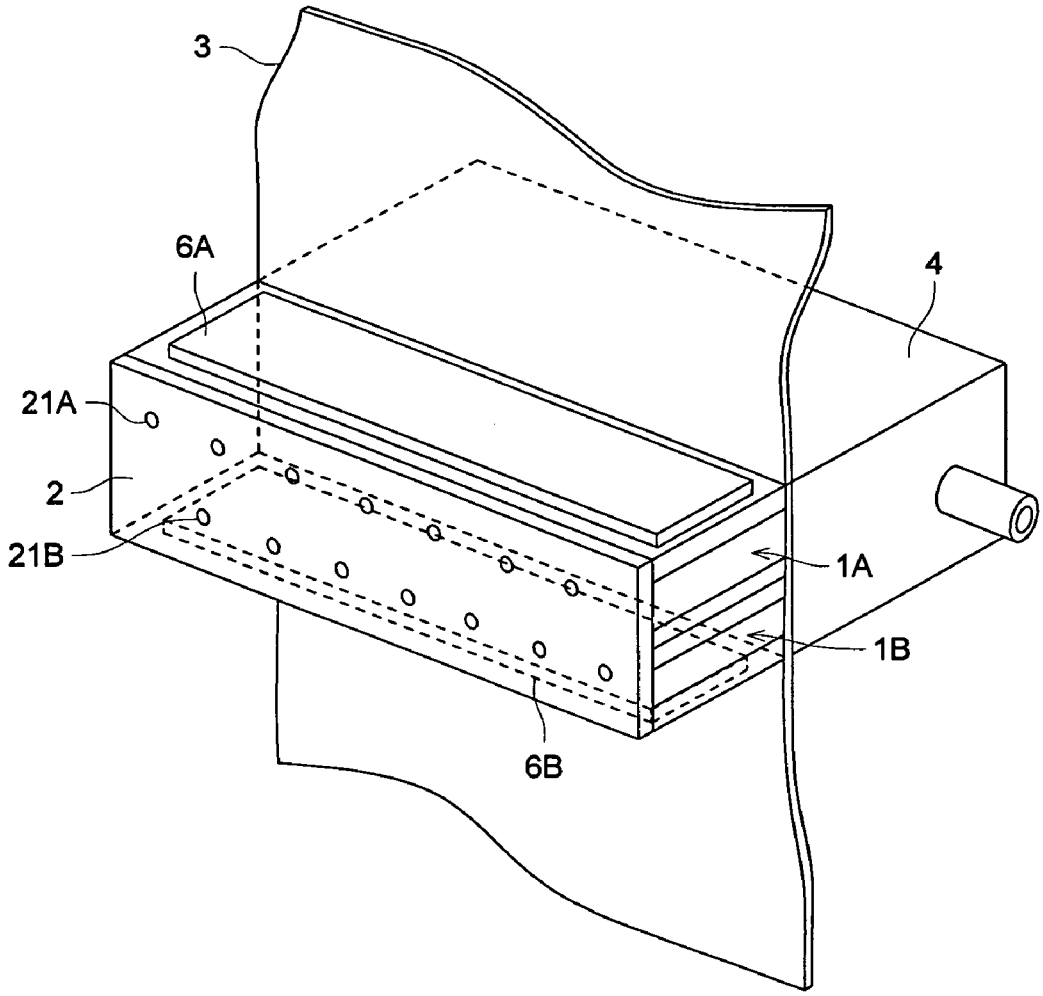
FIG. 12 is a perspective view showing an example of the inkjet print head equipped with a heating member.

When ink must be warmed to eject the ink droplets of high viscosity such as ultraviolet cure ink, heating members 6A and 6B shown in FIG. 12, instead of the heat radiation member, can be mounted. Film heaters are preferably used as the heating members 6A and 6B because they prevent the inkjet print head itself from increasing in size, and ensure more uniform heating of ink than a rod-type heater.

In this case, the ink manifold can be formed by bending the flexible wiring board 3 composed of the FPC backward, using a U-shaped (as viewed from the plane) wall member 40 shown in FIG. 6. Further, the rigid wiring board 7 composed of a photosensitive glass substrate can be used as the flexible wiring board.

The inkjet print head manufactured according to the present invention is not restricted to the one having head chips arranged in multiple layers. It goes without saying that the inkjet print head may contain only one head chip. In this case, free faces are provided by the top surface of the upper substrate 11 and the back surface of the lower substrate 12. The heat radiation member or heating member for all ink channels can be mounted on each of these free faces. This configuration ensures more efficient heat radiation and heating for all ink channels.

The aforementioned embodiment facilitates electrical connection between the connection electrode pulled out of the drive electrode of each ink channel and the drive wire of the flexible wiring board. It also produces an inkjet print head wherein a plurality of rows of ink channels can easily be formed, and more densely packed nozzle configuration is provided.

The aforementioned embodiment allows a large number of ink feed apertures as through-holes to be formed in one operation at less costs. At the same time, it will provide a higher degree of freedom in the direction in which the drive electrode is pulled out of the head chips. Further, this method also ensures a compact structure of the inkjet print head itself.

The aforementioned embodiment simplifies the structure of the ink manifold.

The aforementioned embodiment allows the ink feed apertures as through-holes to be formed easily by exposure of the flexible wiring board. Even if the ink feed apertures are formed for each channel, they can be formed in one operation by using a mask.

The aforementioned embodiment provides easy ink meniscus control and eliminates the need of separately installing a new flow path regulating board. At the same time, it permits reduction in the number of parts and simplification of the structure.

The aforementioned embodiment provides easy production of an inkjet print head containing a large number of rows of ink channels.

The aforementioned embodiment allows an increase in the pitch of the drive wires corresponding to a plurality of head chips, and avoids the risk of electrical short-circuiting.

The aforementioned embodiment allows free faces on the top surface and back surface of the head chip to be utilized to mount the heat radiation members in the direction where the ink channels of the inkjet print head are arranged. This method ensures efficient heat radiation from all ink channels.

The aforementioned embodiment allows free faces on the top surface and back surface of the head chip to be utilized to mount the heating members in the direction where the ink channels of the inkjet print head are arranged. This method ensures efficient heating operation for all ink channels.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An inkjet print head comprising: a plurality of drive walls, arranged at predetermined intervals, composed of piezoelectric devices;

an upper substrate covering a top portion of the plurality of drive walls;

a lower substrate covering a bottom portion of the plurality of drive walls;

a plurality of ink channels enclosed by the drive wall, the upper substrate and the lower substrate;

a drive electrode arranged on each drive wall surface;

a connection electrode, electrically connected with the drive electrode, led out to a surface of an ink inlet of the ink channel;

a nozzle plate, containing nozzles arranged corresponding to the ink channels, for covering an ink outlet side of the ink channel; and a photosensitive glass substrate having an ink feed aperture and a drive electrode electrically connected with a connection wire covering the ink inlet side of the ink channel, wherein the drive electrodes are formed on the photosensitive glass substrate to be extended substantially perpendicular to the upper substrate and the lower substrate in upward or downward directions respectively.

2. The inkjet print head of claim 1, wherein each of the ink channels is designed in a rectangular parallelopiped form, and the respective nozzles and ink feed apertures are provided on the surfaces located opposite to each other.

3. The inkjet print head of claim 1, wherein the plurality of ink channels are arranged in a straight line.

4. The inkjet print head of claim 3, wherein the plurality of ink channels arranged in a straight line are provided in multiple layers.

5. The inkjet print head of claim 1, further comprising a heat radiation member arranged on the upper substrate.

6. The inkjet print head of claim 1, further comprising a heat radiation member arranged on the lower substrate.

7. The inkjet print head of claim 1, further comprising a heating member arranged on the upper substrate.

8. The inkjet print head of claim 1, further comprising a heating member arranged on the lower substrate.

9. The inkjet print head of claim 1, wherein the adjacent drive electrodes are formed to be extended in opposite directions to each other.

* * * * *